US008875466B1

(12) United States Patent
Dearborn

(10) Patent No.: US 8,875,466 B1
(45) Date of Patent: Nov. 4, 2014

(54) MODULAR ELEVATED WALKWAY SYSTEM

(71) Applicant: Kurt P. Dearborn, Hill, NH (US)

(72) Inventor: Kurt P. Dearborn, Hill, NH (US)

( * ) Notice: Subject to any disclaimer, the term of this patent is extended or adjusted under 35 U.S.C. 154(b) by 0 days.

(21) Appl. No.: 14/105,506

(22) Filed: Dec. 13, 2013

(51) Int. Cl.
*E04B 1/64* (2006.01)
*E04B 1/19* (2006.01)

(52) U.S. Cl.
CPC ..... *E04B 1/1903* (2013.01)
USPC ..... 52/650.3; 182/222

(58) Field of Classification Search
CPC ..... E04B 1/19; E04B 1/38; A47B 57/00; A47B 3/08; A47B 57/20
USPC ..... 52/650.3, 71, 64, 69; 182/92, 116, 152, 182/232; 248/346.01, 346.02; 108/64, 65, 108/115
See application file for complete search history.

(56) References Cited

U.S. PATENT DOCUMENTS

| | | | | | |
|---|---|---|---|---|---|
| 2,406,237 | A | * | 8/1946 | Milkoff | 190/11 |
| 4,340,130 | A | * | 7/1982 | Payne et al. | 182/186.9 |
| 4,580,776 | A | * | 4/1986 | Burkinshaw | 52/7 |
| 4,872,295 | A | * | 10/1989 | Fujita | 52/7 |
| 4,919,229 | A | | 4/1990 | Wells | |
| 4,934,486 | A | | 6/1990 | Butler et al. | |
| 5,000,290 | A | * | 3/1991 | Seely | 182/222 |
| 5,054,580 | A | * | 10/1991 | Cheek | 182/179.1 |
| 5,072,955 | A | | 12/1991 | Holland et al. | |
| 5,133,429 | A | | 7/1992 | Densley | |
| 5,438,937 | A | * | 8/1995 | Ball et al. | 108/64 |
| 5,568,775 | A | * | 10/1996 | Rizzi et al. | 108/64 |
| 5,669,463 | A | | 9/1997 | Robertson | |
| D394,628 | S | | 5/1998 | Wentzel | |
| 5,746,288 | A | * | 5/1998 | O'Neal et al. | 182/118 |
| 6,082,051 | A | * | 7/2000 | Burton et al. | 52/7 |
| 6,598,542 | B2 | * | 7/2003 | Goldberg et al. | 108/64 |
| 7,219,910 | B2 | | 5/2007 | Dunford | |
| 7,779,762 | B2 | * | 8/2010 | Sackman | 108/25 |
| 2009/0056595 | A1 | * | 3/2009 | Dean et al. | 108/24 |

FOREIGN PATENT DOCUMENTS

| | | |
|---|---|---|
| CA | 2591734 | 12/2008 |

* cited by examiner

*Primary Examiner* — Brian Glessner
*Assistant Examiner* — Beth Stephan

(57) ABSTRACT

A modular elevated walkway system elevates a person and places them in close proximity to an engine compartment to enable the person to conduct maintenance on components of the engine. The system includes a plurality of platform units. Each of the platform units is coupled to an adjacently positioned one of the platform units. Each of the platform units includes a platform having a planar upper surface configured for supporting the weight of a person standing thereupon. A plurality of legs is coupled to and extends downwardly from the associated platform. The legs are configured to support the associated platform above a ground surface.

9 Claims, 5 Drawing Sheets

MODULAR ELEVATED WALKWAY SYSTEM

BACKGROUND OF THE DISCLOSURE

Field of the Disclosure

The disclosure relates to walkway systems and more particularly pertains to a new walkway system for elevating a person and placing them in close proximity to an engine compartment to enable the person to conduct maintenance on components of the engine.

SUMMARY OF THE DISCLOSURE

An embodiment of the disclosure meets the needs presented above by generally comprising a plurality of platform units. Each of the platform units is coupled to an adjacently positioned one of the platform units. Each of the platform units includes a platform having a planar upper surface configured for supporting the weight of a person standing thereupon. A plurality of legs is coupled to and extends downwardly from the associated platform. The legs are configured to support the associated platform above a ground surface.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
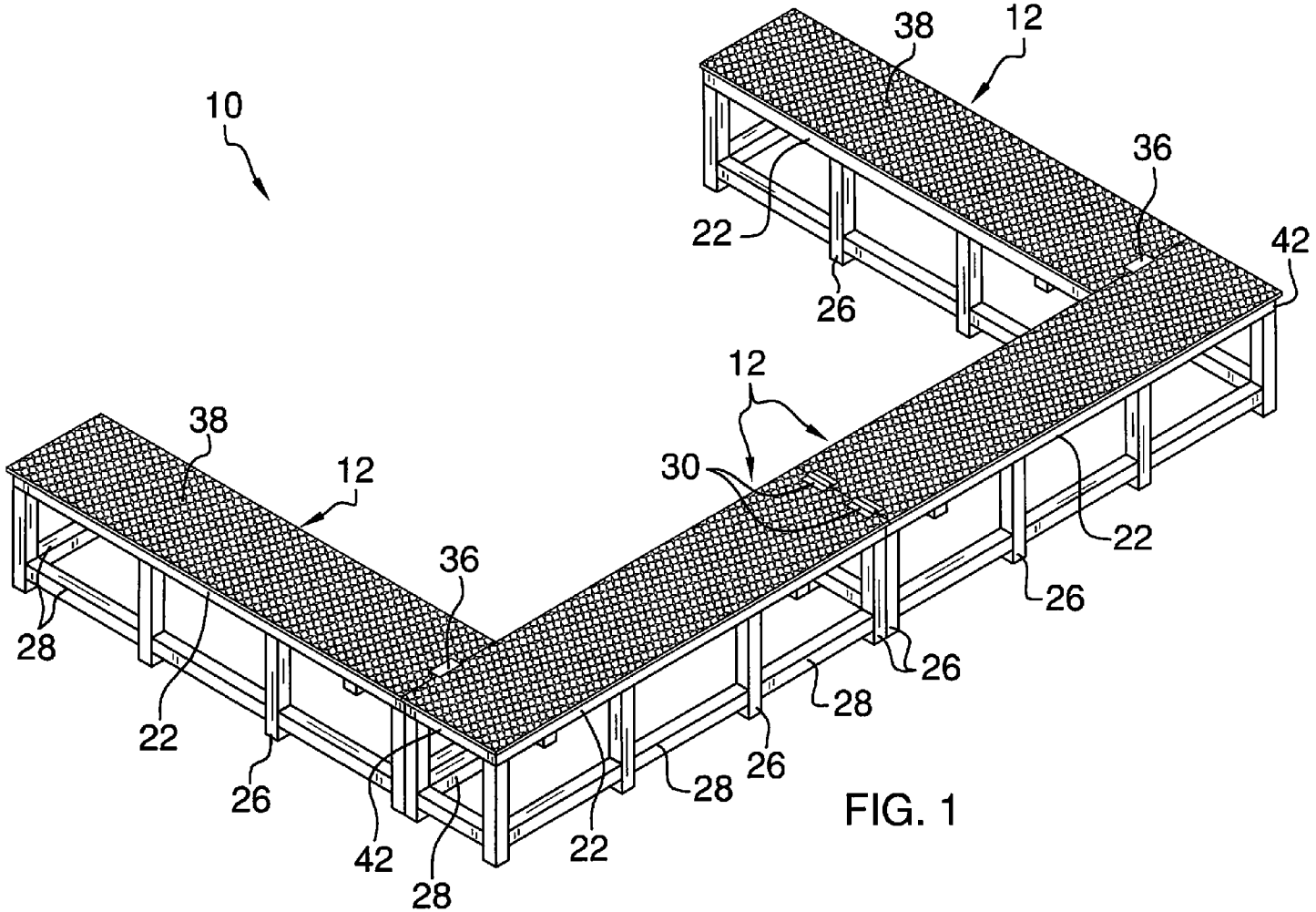
FIG. 1 is a top front side perspective view of a modular elevated walkway system according to an embodiment of the disclosure.
Figure 2:
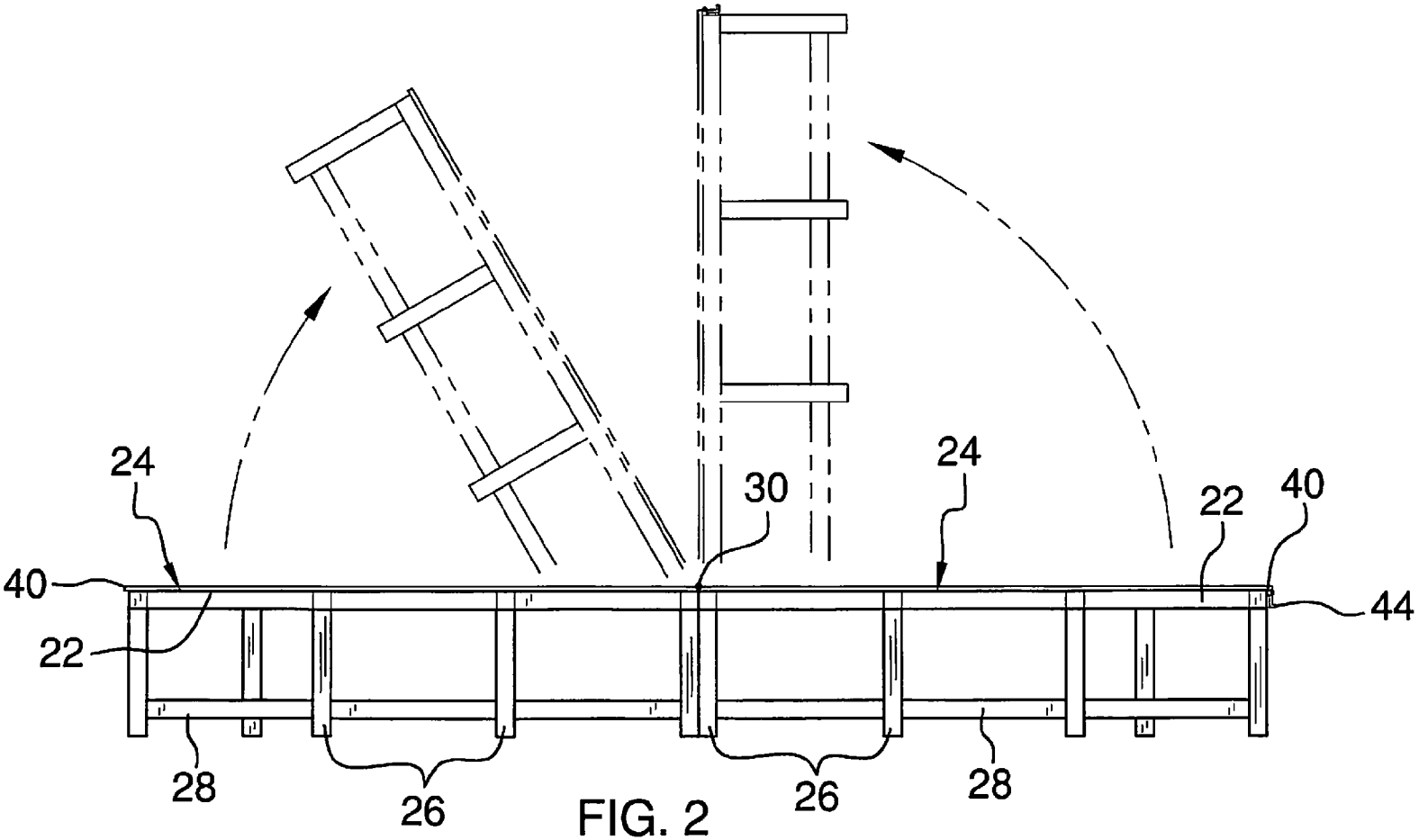
FIG. 2 is a front view of an embodiment of the disclosure.
Figure 3:
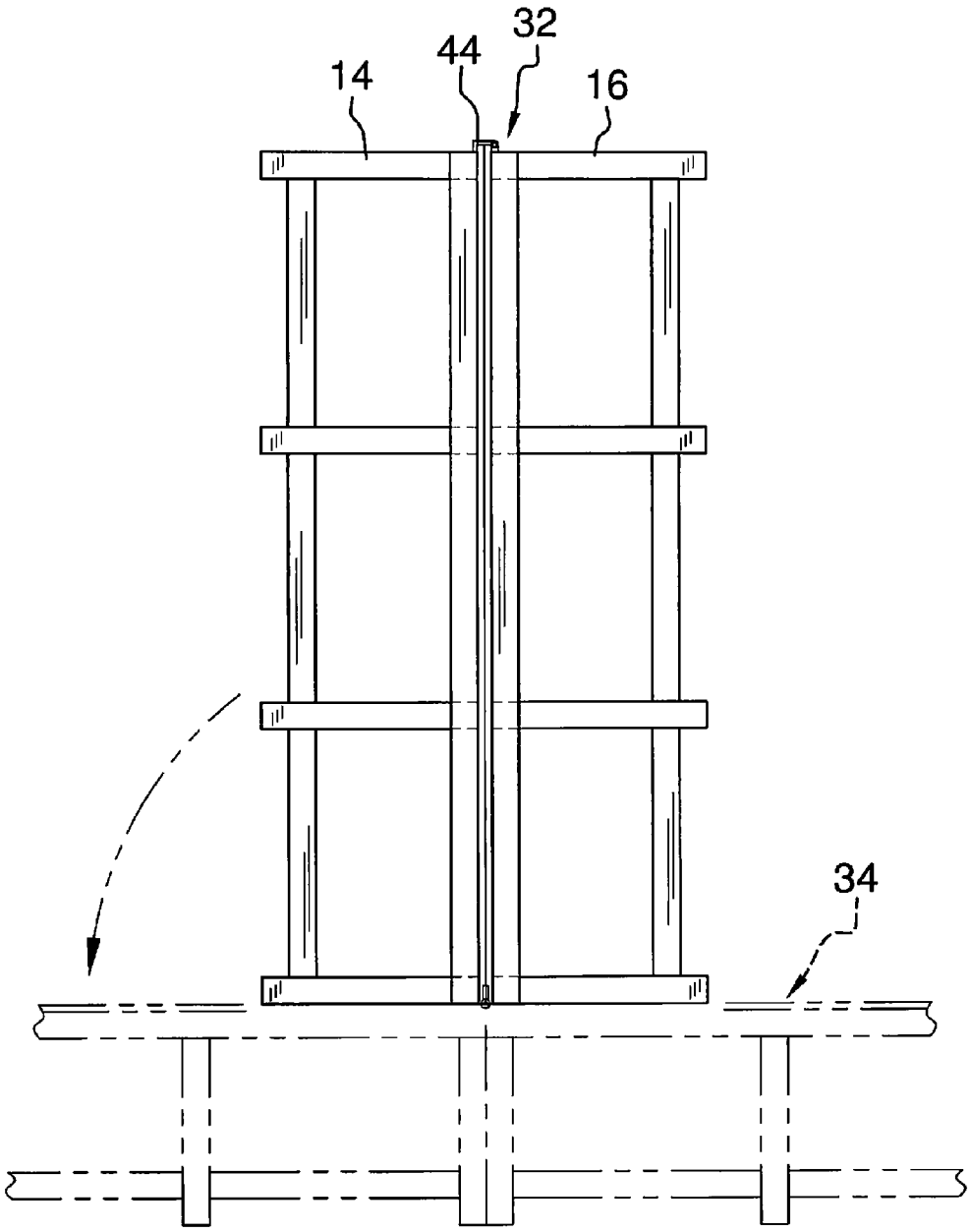
FIG. 3 is a front view of an embodiment of the disclosure similar to FIG. 2, except that FIG. 3 shows the front platform units in a folded position.
Figure 4:
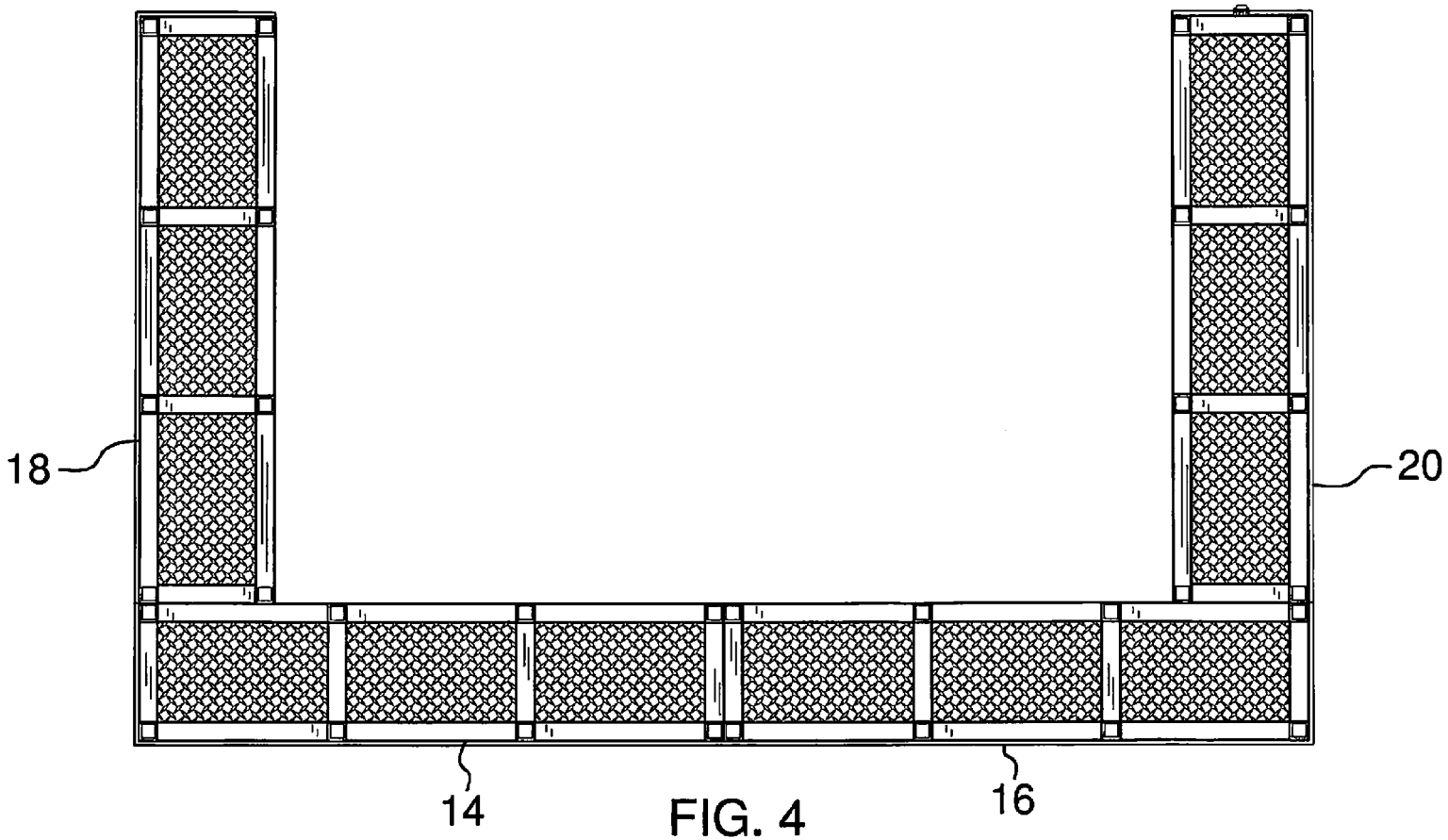
FIG. 4 is a bottom view of an embodiment of the disclosure.
Figure 5:
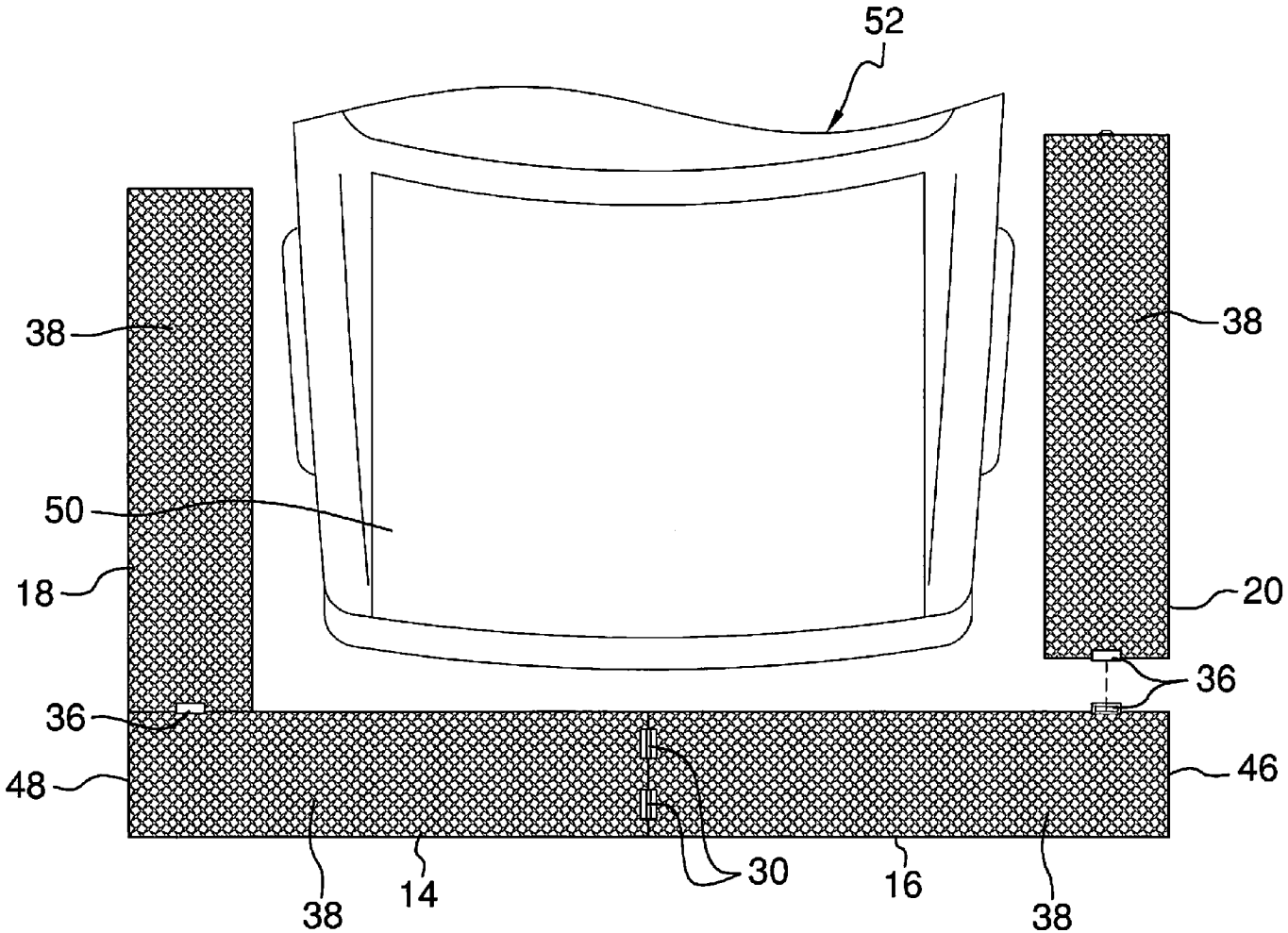
FIG. 5 is a top view of an embodiment of the disclosure.

With reference now to the drawings, and in particular to FIGS. 1 through 5 thereof, a new walkway system embodying the principles and concepts of an embodiment of the disclosure and generally designated by the reference numeral 10 will be described.

As best illustrated in FIGS. 1 through 5, the modular elevated walkway system 10 generally comprises a plurality of platform units 12. Each of the platform units 12 is coupled to an adjacently positioned one of the platform units 12. Each of the platform units 12 abuts the adjacently positioned one of the platform units 12. The plurality of platform units 12 comprises a first front platform unit 14, a second front platform unit 16 and at least a first 18 and a second side platform unit 20. In particular, the first front platform unit 14 is coupled to the second front platform unit 16; the first side platform unit 18 is coupled to the first front platform unit 14; and the second side platform unit 20 is coupled to the second front platform unit 16. Each of the platform units 12 is comprised of a strong material, such as steel or the like. The system 12 may have a height between approximately 25.0 centimeters and 55.0 centimeters and a width between approximately 40.0 centimeters and 80.0 centimeters. Each of the platform units 12 may have a length between approximately 90.0 centimeters and 140.0 centimeters.

Each of the platform units 12 includes a platform 22 having a planar upper surface 24 configured for supporting the weight of a person standing thereupon. A plurality of legs 26 is coupled to and extends downwardly from the associated platform 22. The legs 26 are configured to support the associated platform 22 above a ground surface. A plurality of cross-bars 28 is provided. Each of the cross-bars 28 is coupled to and extends between associated legs 26 of each of the platform units 12.

At least one hinge 30 couples the first 14 and second 16 front platform units together for selectively pivoting the first 14 and second 16 front platform units between a folded position 32 and an unfolded position 34. The planar upper surfaces 24 of each of the first 14 and second 16 front platform units abut each other when the first 14 and second 16 front platform units are in the folded position 32.

Each of the platform units 12 is removably coupled to the adjacently positioned one of the platform units 12. A pair of connectors 36 is provided. One of the connectors 36 releasably couples the first front platform unit 14 to the first side platform unit 18. Similarly, another one of the connectors 36 releasably couples the second front platform unit 16 to the second side platform unit 20. The connectors 36 may be constructed from a durable material, such as steel, PVC plastic or the like.

A plurality of plates 38 is provided. Each plate 38 is coupled to the upper surface 24 of an associated platform 22. Each plate 38 has an extension portion 40 extending outwardly beyond a perimeter edge 42 of the associated platform 22. In particular, the plates 38 may comprise an aluminum diamond plate decking as shown in the Figures. A fastener 44 is coupled to the second front platform unit 16 proximate a first lateral edge 46 of the platform 22 of the second front platform unit 16. The fastener 44 selectively engages the extension portion 40 of the plate 38 on the platform 22 of the first front platform unit 14 proximate a first lateral edge 48 of the platform 22 of the first front platform unit 14 for retaining the first 14 and second 16 front platform units in the folded position 32.

In use, as stated above and shown in the Figures, the platform units 12 are coupled together as described above. A front section 50 of a vehicle 52 is then positioned between the first 18 and second 20 side platform units adjacent to the first 14 and second 16 front platform units. A user is able to walk upon each of the platform units 12 to get in close proximity to the vehicle's engine so that the user may clean, repair or replace various components of the vehicle's 52 engine. After use, the first 14 and second 16 front platform units are positioned in the folded position 32 for compact storage of the system 10.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A modular elevated walkway system comprising:

a plurality of platform units, each of said platform units having a first lateral edge and an opposite second lateral edge and being coupled at the second lateral edge to the second later edge of an adjacently positioned one of said platform units between a folded position and an unfolded position, each of said platform units including;

a platform having a planar upper surface configured for supporting the weight of a person standing thereupon when in the unfolded position; and a plurality of legs coupled to and extending downwardly from said associated platform, said legs being configured to support said associated platform above a ground surface when in the unfolded position;

a plurality of plates, one of said plates being coupled to said upper surface of each of said platforms, each said plate having an extension portion extending outwardly from the first lateral edge beyond a perimeter edge of said associated platform; and a fastener coupled to an associated extension portion of said plate of one of said platform units, said fastener selectively engaging said extension portion of said plate on an adjacently positioned one of said platform units for securing said associated platform units together in a folded position such that said planar upper surfaces of said adjacent platform units abut each other.

2. The system of claim 1, further comprising each of said platform units abutting said adjacently positioned one of said platform units.

3. The system of claim 1, further comprising:

said plurality of platform units comprising a first front platform unit, a second front platform unit and at least a first and a second side platform unit; and wherein said first front platform unit is coupled to said second front platform unit, wherein said first side platform unit is coupled to said first front platform unit, and wherein said second side platform unit is coupled to said second front platform unit.

4. The system of claim 1, further comprising: said platform units including a first front platform unit coupled to a second front platform unit; and at least one hinge coupling said first and second front platform units together for selectively pivoting said first and second front platform units between the folded position and the unfolded position.

5. The system of claim 1, further comprising a plurality of cross-bars, each of said cross-bars being coupled to and extending between associated said legs of each of said platform units.

6. The system of claim 1, further comprising each of said platform units being removably coupled to said adjacently positioned one of said platform units.

7. The system of claim 3, further comprising:

each of said platform units being removably coupled to said adjacently positioned one of said platform units; and a pair of connectors, one of said connectors releasably coupling said first front platform unit to said first side platform unit, one of said connectors releasably coupling said second front platform unit to said second side platform unit.

8. The system of claim 4, further comprising said planar upper surfaces of each of said first and second front platform units abutting each other when said first and second front platform units are in the folded position.

9. A modular elevated walkway system comprising:

a plurality of platform units, each of said platform units being coupled to an adjacently positioned one of said platform unit, each of said platform units abutting said adjacently positioned one of said platform units, said plurality of platform units comprising a first front platform unit, a second front platform unit and at least a first and a second side platform unit, each of the said front platform units having a first lateral edge and an opposite second lateral edge, said first front platform unit being coupled to said second front platform unit at said second lateral edges of said front platform units, said first side platform unit being coupled to said first front platform unit, said second side platform unit being coupled to said second front platform unit, each of said platform units including;

a platform having a planar upper surface configured for supporting the weight of a person standing thereupon when in an unfolded postion; and a plurality of legs coupled to and extending downwardly from said associated platform, said legs being configured to support said associated platform above a ground surface when in the unfolded postion;

at least one hinge coupling said second lateral edges of said first and second front platform units together for selectively pivoting said first and second front platform units between a folded position and the unfolded position, said planar upper surfaces of each of said first and second front platform units abutting each other when said first and second front platform units are in the folded position;

a plurality of cross-bars, each of said cross-bars being coupled to and extending between associated said legs of each of said platform units; each of said platform units being removably coupled to said adjacently positioned one of said platform units;

a pair of connectors, one of said connectors releasably coupling said first front platform unit to said first side platform unit, one of said connectors releasably coupling said second front platform unit to said second side platform unit;

a plurality of plates, one of said plates being coupled to said upper surface of each of said platforms, each said plate having an extension portion extending outwardly from the first lateral edge of the platform units beyond a perimeter edge of said associated platform; and a fastener coupled to said extension portion of said plate of said second front platform unit, said fastener selectively engaging said extension portion of said plate on said platform of said first front platform unit for retaining said first and second front platform units in the folded position.

* * * * *